US011203476B2

(12) United States Patent
Zacherle et al.

(10) Patent No.: US 11,203,476 B2
(45) Date of Patent: Dec. 21, 2021

(54) PRODUCT PACKAGE, DISPLAY CARD, CLIP AND BLANK THEREFOR

(71) Applicant: WestRock MWV, LLC, Atlanta, GA (US)

(72) Inventors: Matthew E. Zacherle, Chesterfield, VA (US); Cullen B. Rosenbrien, Richmond, VA (US)

(73) Assignee: WESTROCK MWV, LLC, Atlanta, GA (US)

( * ) Notice: Subject to any disclaimer, the term of this patent is extended or adjusted under 35 U.S.C. 154(b) by 24 days.

(21) Appl. No.: 16/670,025

(22) Filed: Oct. 31, 2019

(65) Prior Publication Data

US 2020/0140169 A1 May 7, 2020

Related U.S. Application Data

(60) Provisional application No. 62/754,906, filed on Nov. 2, 2018.

(51) Int. Cl.
*B65D 73/00* (2006.01)

(52) U.S. Cl.
CPC ..... *B65D 73/0064* (2013.01); *B65D 73/0014* (2013.01)

(58) Field of Classification Search
CPC ..... B65D 73/00; B65D 73/0014; B65D 73/0064; B65D 73/0092; B65D 75/32; B65D 75/36; B65D 75/52; B65D 75/56
USPC ..... 206/349, 461, 462, 471, 477
See application file for complete search history.

(56) References Cited

U.S. PATENT DOCUMENTS

| | | | | |
|---|---|---|---|---|
| 4,165,805 | A * | 8/1979 | Fethke | B65D 75/366 206/349 |
| 5,279,417 | A * | 1/1994 | Seaton | B65D 75/22 206/349 |
| 8,800,768 | B2 * | 8/2014 | Corbat | B65D 73/0092 206/470 |
| 10,220,995 | B2 * | 3/2019 | Zacherle | B65D 75/563 |
| 2009/0065386 | A1 * | 3/2009 | Hasegawa | B65D 73/0014 206/349 |
| 2015/0344207 | A1 * | 12/2015 | Zacherle | B65D 75/522 206/462 |

* cited by examiner

*Primary Examiner* — Bryon P Gehman
(74) *Attorney, Agent, or Firm* — Neil G. Cohen

(57) ABSTRACT

Aspects of the disclosure relate to a package, a product carrier, clip and a blank for forming the product carrier. An aspect of the invention provides a package comprising a display card and a clip. An article is mounted to the display card by the clip. The display card comprises a front panel and a rear panel. The clip comprises a front wall and opposed side walls. The clip together with at least one of the front and rear panels forms a tubular structure for receiving a part of the article. The article comprises at least one limb. The article is mounted to the display card by the at least one limb which extends through the tubular structure.

12 Claims, 18 Drawing Sheets

PRODUCT PACKAGE, DISPLAY CARD, CLIP AND BLANK THEREFOR

REFERENCE TO RELATED APPLICATION

This application claims the benefit of priority under 35 U.S.C. § 119(e) of U.S. Provisional Patent Application Ser. No. 62/754,906 filed on Nov. 2, 2018, which is hereby incorporated by reference in its entirety.

TECHNICAL FIELD

The present invention relates to product packaging, to display cards, clips or blisters and to blanks for forming the same. More specifically, but not exclusively, the invention relates to a carrier providing a display card having a clip for mounting a product thereto and to a blank for forming the display card.

BACKGROUND

In the field of packaging it is known to provide display cards for mounting to articles or products thereto. Display cards are well known in the art and are useful for display of product information to a consumer, display of the articles in a retail environment and enabling consumers to transport, store and access the product.

Manufacturers and retailers of consumer goods, such as household items, pharmaceuticals, software, electronics, health and beauty products, hand tools and the like, typically package their products in tamper resistant security packages. For example, many consumer goods are packaged inside a blister or clamshell packages formed by positioning a consumer good in a flanged blister made from various polymeric and/or paperboard materials and sealing the flanged blister between two paperboard substrates. Alternatively, the product may be secured to the paperboard card by cable ties (zip ties), the cable tie passing through a pair of apertures in the paperboard card.

It is desirable to expose some or all of the product, whilst on display, to a consumer to allow inspection of the product and it is desirable to maximise the visual or aesthetic impact the package has upon the consumer.

It is further desirable to provide the consumer with information about the product without hindering the consumer's ability to inspect the product. It is also desirable that the product carrier is resistant to tampering, removal or separation from the product.

The present invention seeks to provide an improvement in product packaging, typically formed from paperboard or the like.

SUMMARY

A first aspect of the present disclosure provides a package comprising a display card and a clip. An article is mounted to the display card by the clip. The display card comprises a front panel and a rear panel. The clip comprises a front wall and opposed side walls. The clip together with at least one of the front and rear panels forms a tubular structure for receiving a part of the article. The article comprises at least one limb. The article is mounted to the display card by the at least one limb which extends through the tubular structure.

Optionally, the front panel comprises a first front panel portion hingedly connected to the rear panel.

Optionally, the front panel comprises a second front panel portion arranged complementarily to the first front panel portion so as to form a substantially complete front display region for display of indicia.

Optionally, the second front panel portion is struck from the front panel.

Optionally, the article comprises a pair of limbs and the article is mounted to the display card by at least one of the pair of limbs.

Optionally, the clip is mounted on said at least one limb between a pair of end stops for inhibiting removal of the article from the display card.

Optionally, the at least one limb comprises a handle.

Optionally, the clip comprises at least one flange disposed between the front and rear panels.

Optionally, the front panel comprises one or more cutaways or apertures defining one or more abutment edges in the front panel for engaging with a portion of the clip which extends through said one or more cutaways or apertures.

Optionally, the display card is formed from a paperboard substrate.

Optionally, the clip comprises at least one boss received in a receiver defined in the front panel.

Optionally, the paperboard substrate comprises a tear resistant layer.

Optionally, the clip is formed from a plastics material.

A second aspect of the present disclosure provides a display card for receiving an article. The display card comprises a front panel, a rear panel and a clip. The clip comprises a front wall, opposed side walls and at least one flange. The clip together with at least one of the front and rear panels forms a tubular structure for receiving a part of the article so as to enable the article to be mounted to the display card. The at least one flange is disposed between the front panel and the rear panel. Each of the opposed side walls of the clip extends through a cutaway in the front panel.

Optionally, the front panel comprises a first front panel portion hingedly connected to the rear panel.

Optionally, the front panel comprises a second front panel portion arranged complementarily to the first front panel portion so as to form a substantially complete front display region for display of indicia.

Optionally, the second front panel portion is struck from the front panel.

A third aspect of the present disclosure provides a blank for forming a display card. The blank comprises a front panel and a rear panel. The front panel comprises a first front panel portion hingedly connected to the rear panel and a second front panel portion arranged complementarily to the first front panel portion. The first front panel portion and the second front panel portion form a substantially complete front display region for display of indicia.

Optionally, the second front panel portion is struck from the front panel and is separable therefrom.

Optionally, at least one of the first front panel portion and a second front panel portion comprises at least one cutaway defining at least one aperture in the front panel for receiving a portion of a clip.

Optionally, the blank is formed from a paperboard substrate having a tear resistant layer.

Optionally, the article is a pair of pliers, snips, scissors or similar.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the product package, product carrier, display card, clip and blank are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the product packages, product carriers, display cards, clips and blanks described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
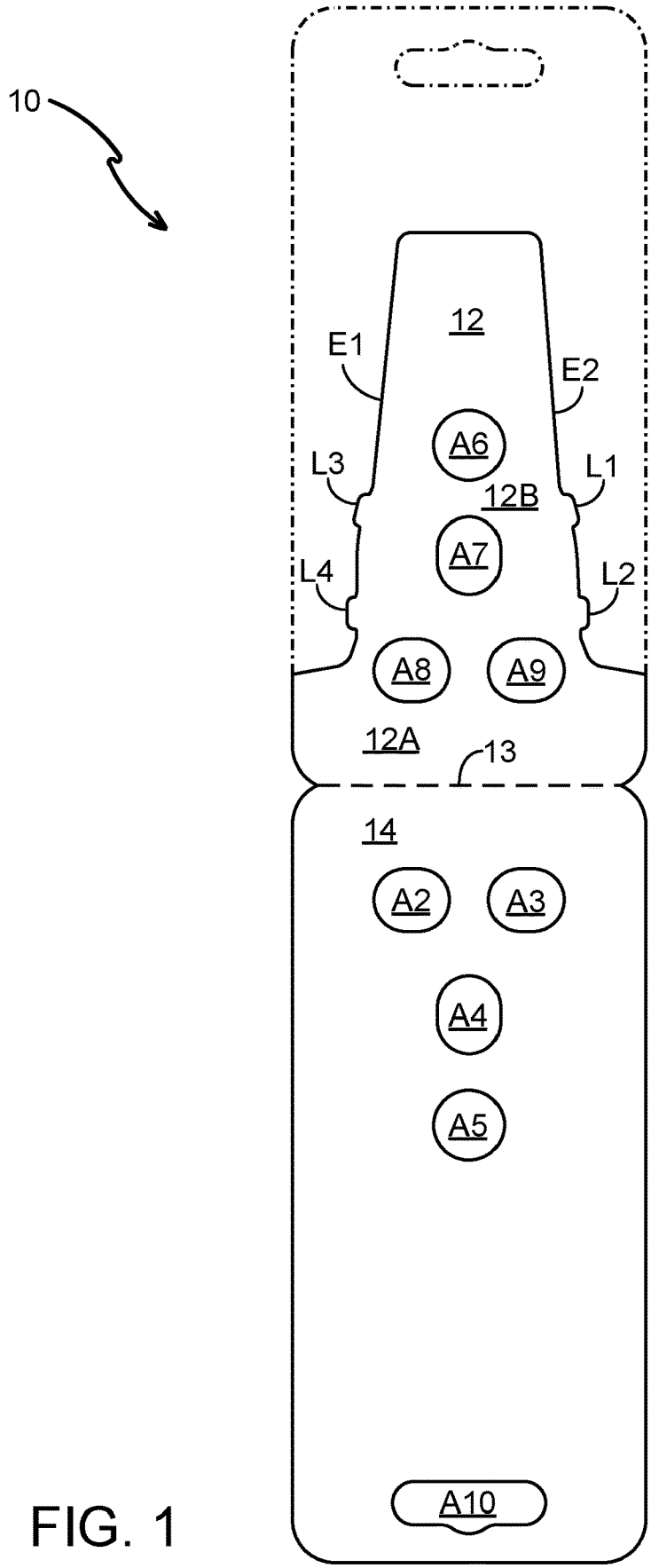
FIG. 1 is a plan view from above of a first blank for forming a product package according to a first embodiment.
Figure 2:
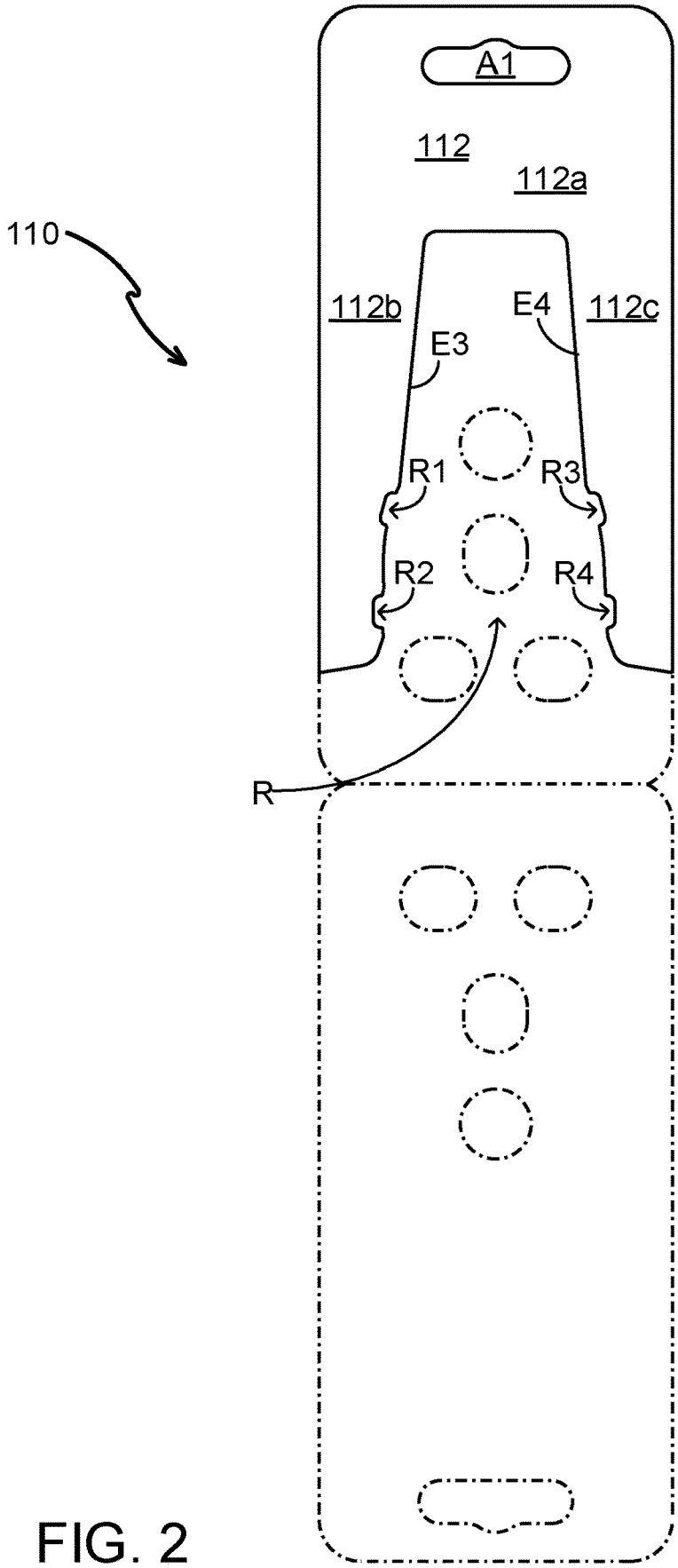
FIG. 2 is a plan view from above of a second blank for forming a product package according to a first embodiment.
Figure 3D:
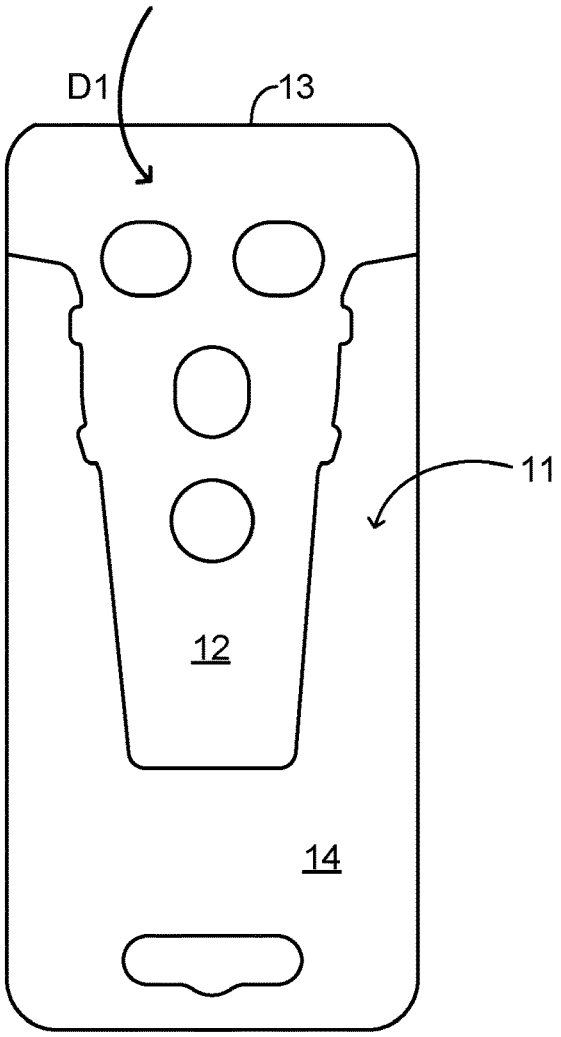
FIG. 3D illustrates a stage of construction of a display card from the blank of FIG. 1.
Figure 3B:
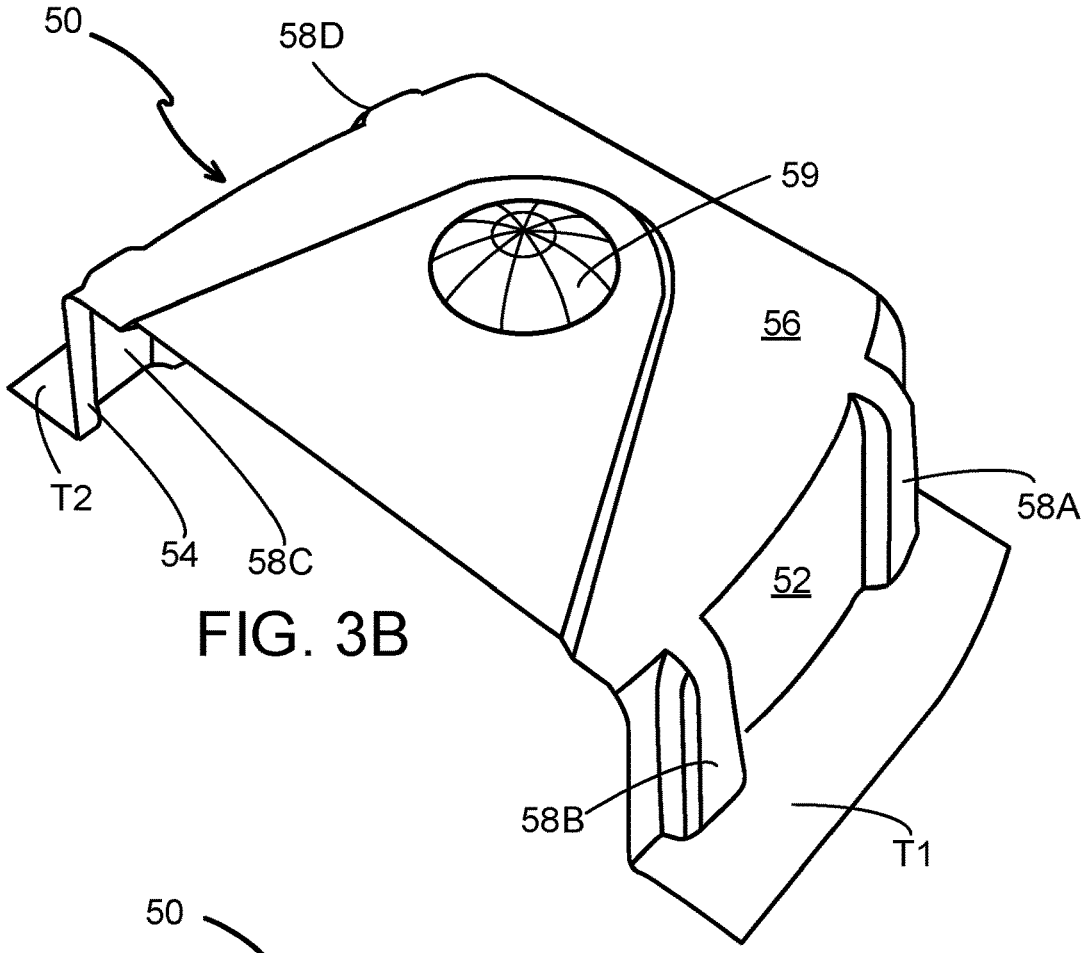
FIGS. 3B and 3C are perspective and top views a clip for forming a product package with the blank of FIGS. 1 and 2.
Figure 3C:
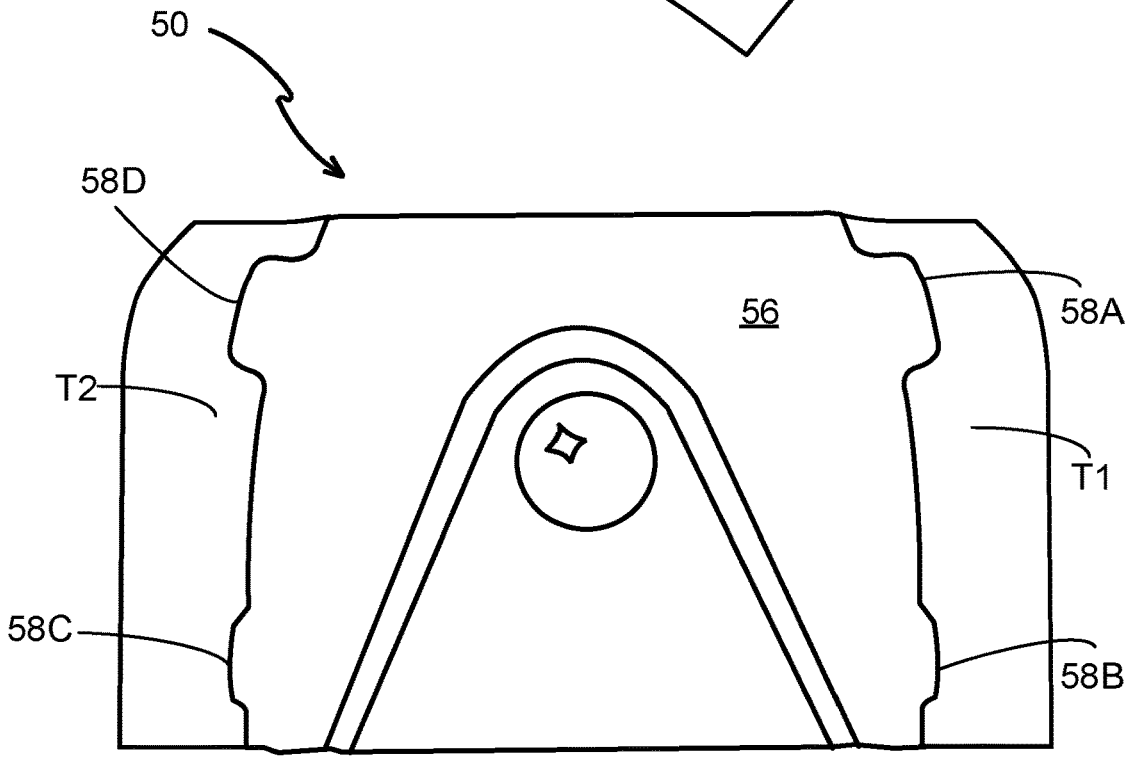
Figure 4:
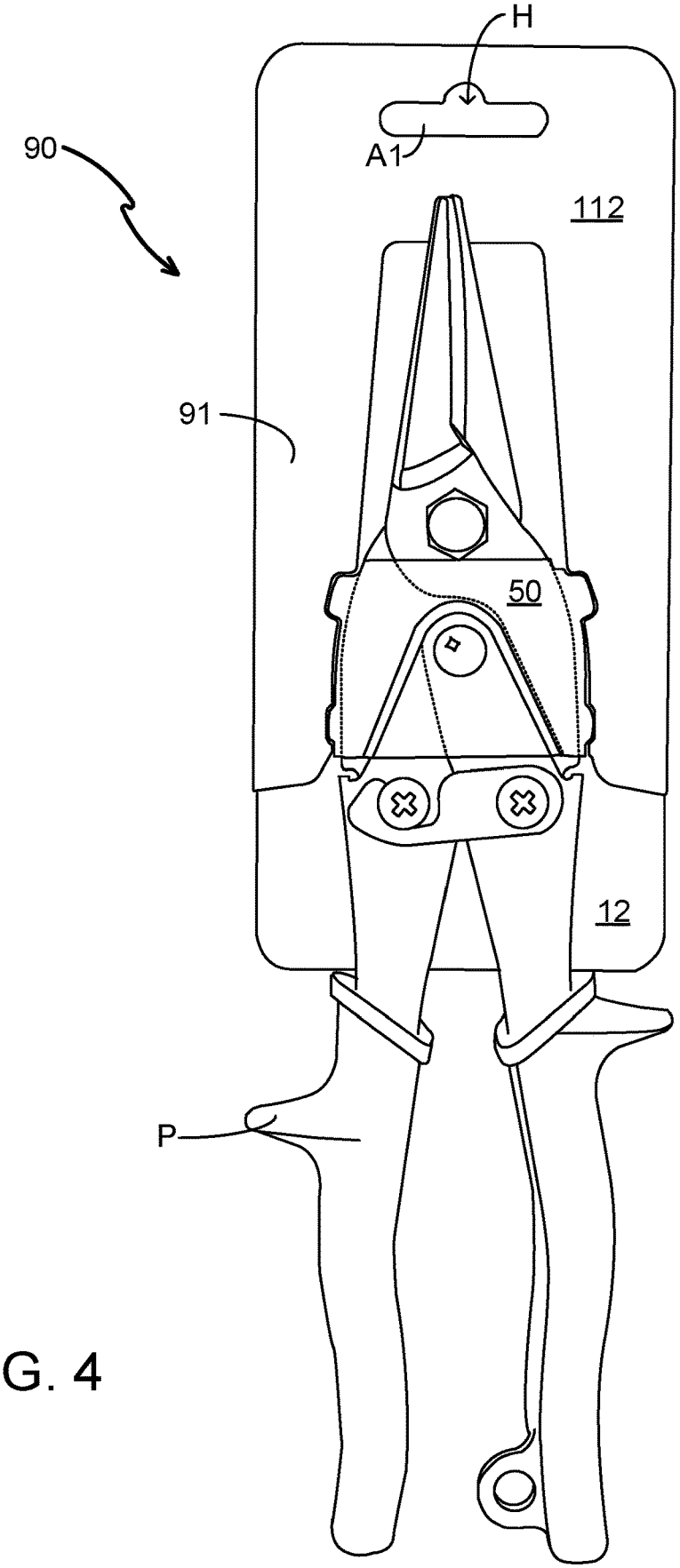
FIG. 4 is a perspective front view of a product package formed from the blank of FIGS. 1 and 2.
Figure 5:
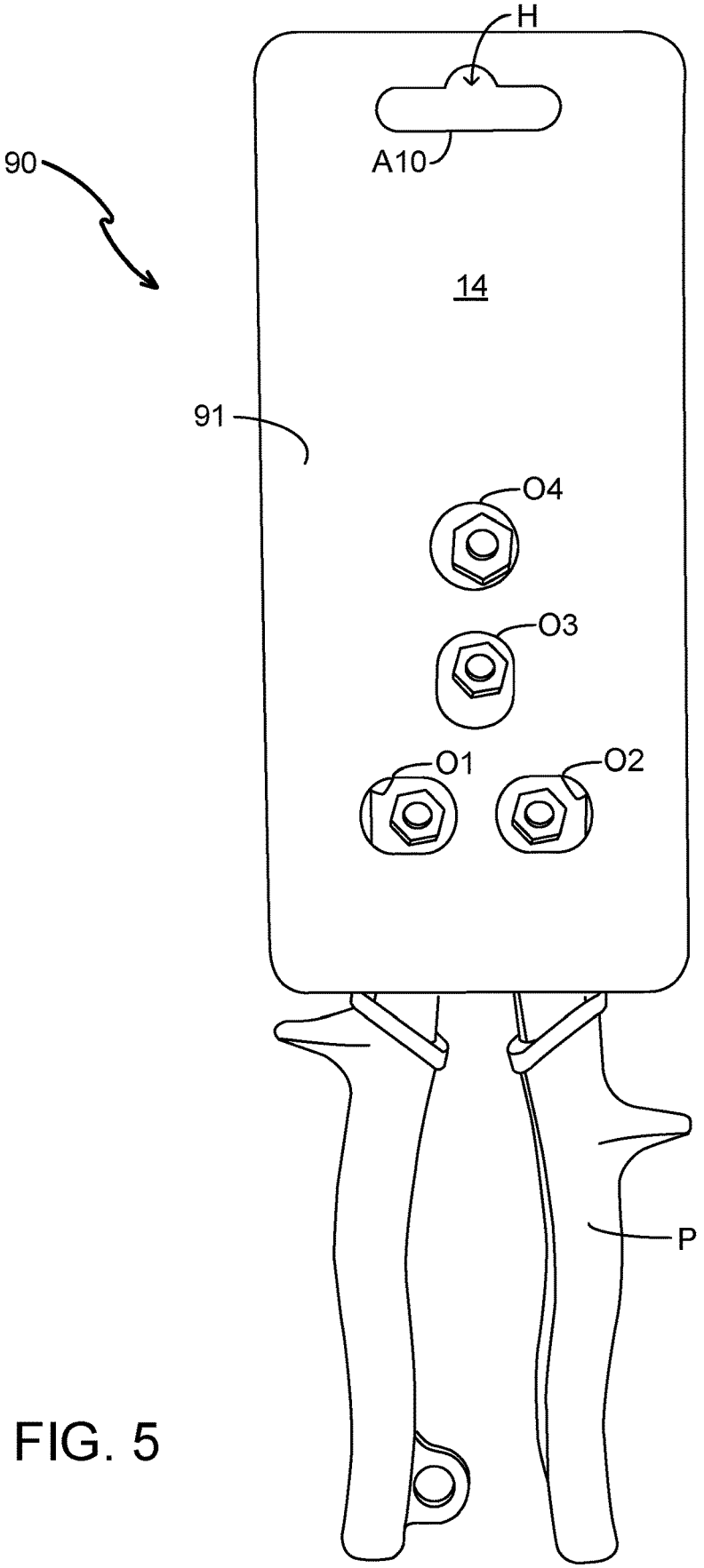
FIG. 5 is a perspective rear view of a product package formed from the blank of FIGS. 1 and 2.

Referring to FIGS. 1 and 2, there is shown plan views of a first blank 10 and a second blank 110, according to an embodiment of the disclosure, capable of forming a packaging structure 90 in the form of a display card, as shown in FIGS. 4 and 5. FIGS. 3B and 3C show clip or trap for mounting to a primary product such as, but not limited to, a hand tool in the form of a snips, shears, scissors, wire cutter or stripper, pliers, pincers, crimp tools or the like, hereinafter also referred to as article P to the display card. The display card and clip form a product or article carrier. The clip or trap may take the form of a blister defining a cavity or pocket. The blister may be made from a formable web, usually by thermoforming a thermoplastic such as, but not limited to, polyvinyl chloride (PVC).

Figure 7A:
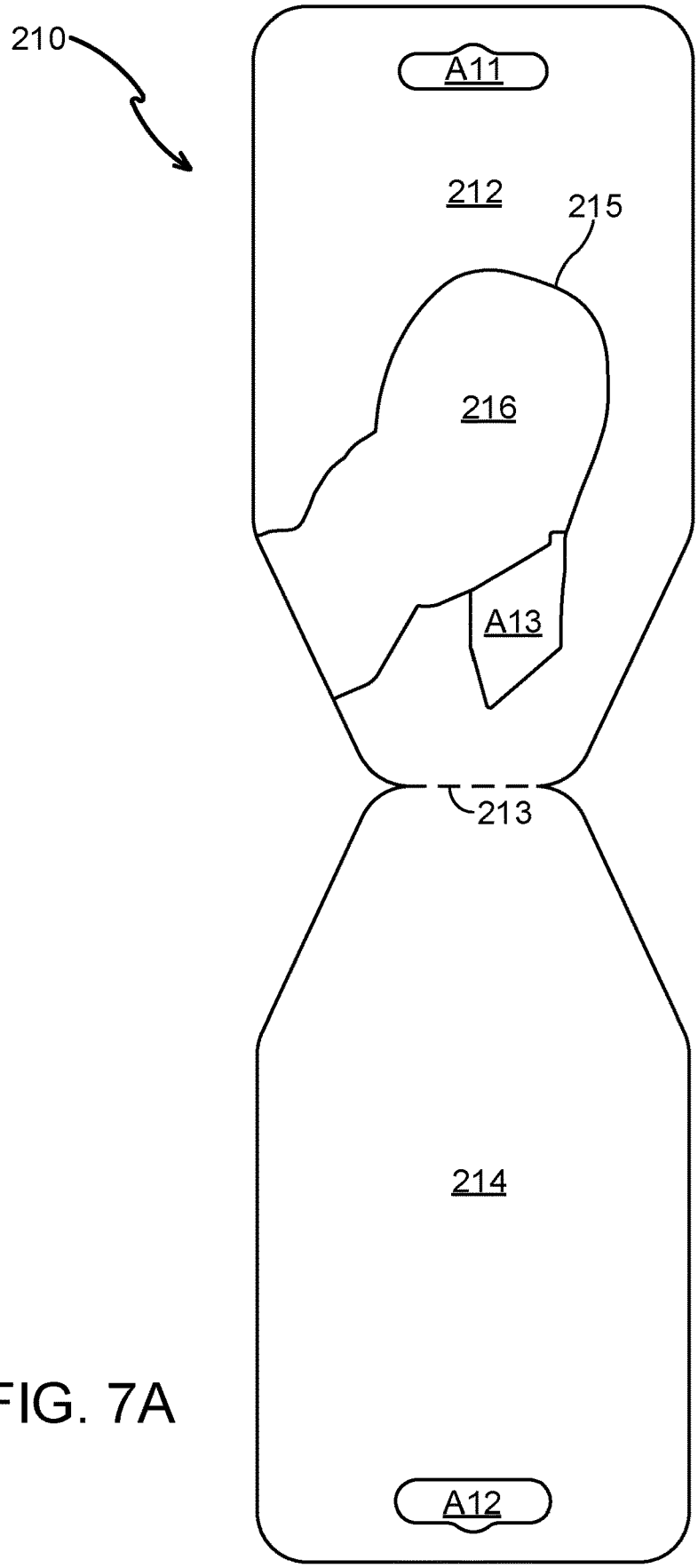
FIG. 7A is a plan view from above of a blank for forming a product package according to a second embodiment.
Figure 11:
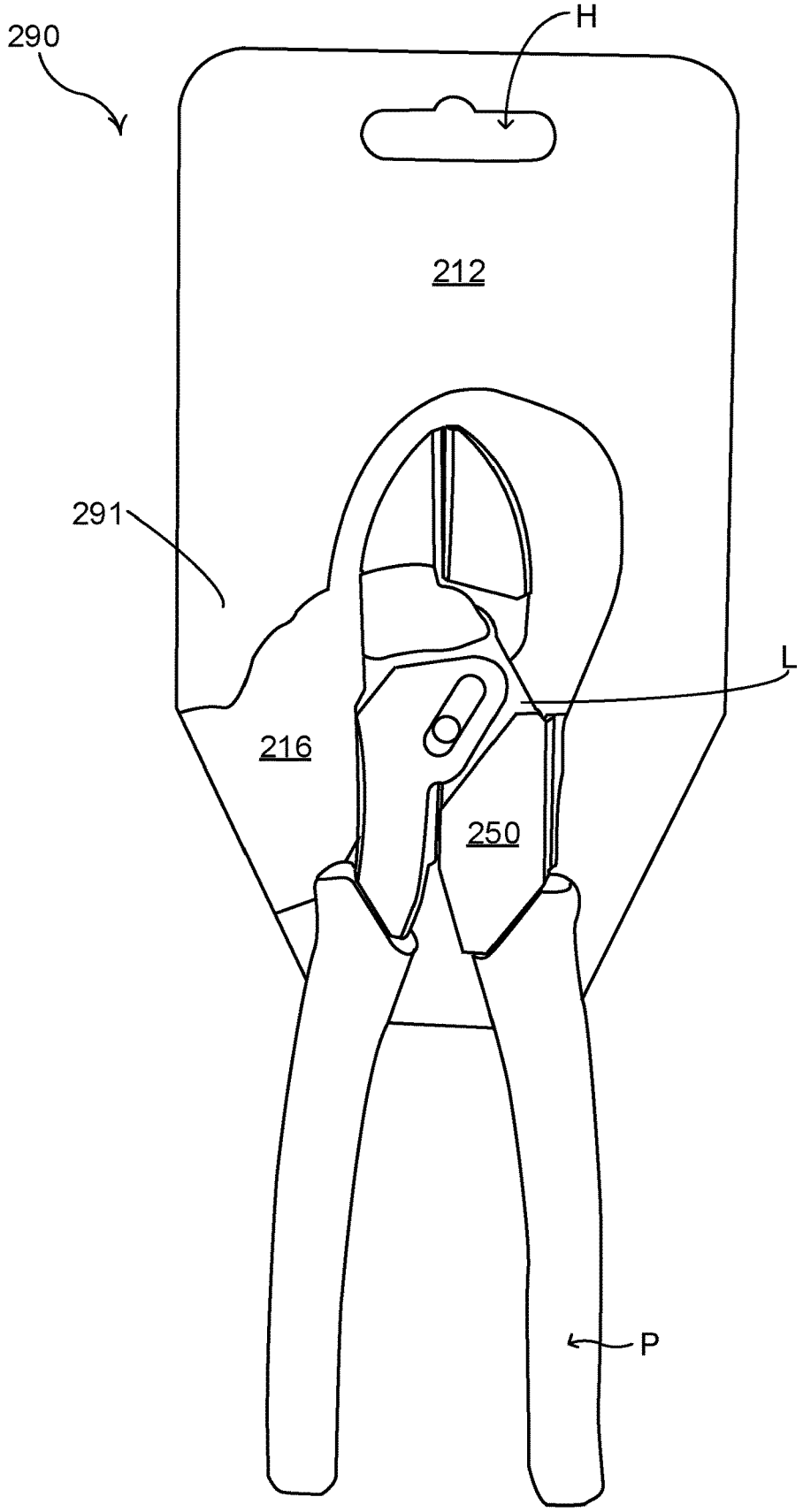
FIG. 11 is a perspective front view of a product packaged in a package formed from the blank of FIG. 7 and the clip of FIGS. 8A to 8D.

Referring to FIG. 7A, there is shown a plan view of a blank 210, according to an alternative embodiment of the disclosure, capable of forming a packaging structure 290 in the form of a display card, as shown in FIG. 11. FIGS. 8A to 8D show an alternative clip or trap for mounting to an article P to the display card. The display card and clip form a product or article carrier.

Figure 12:
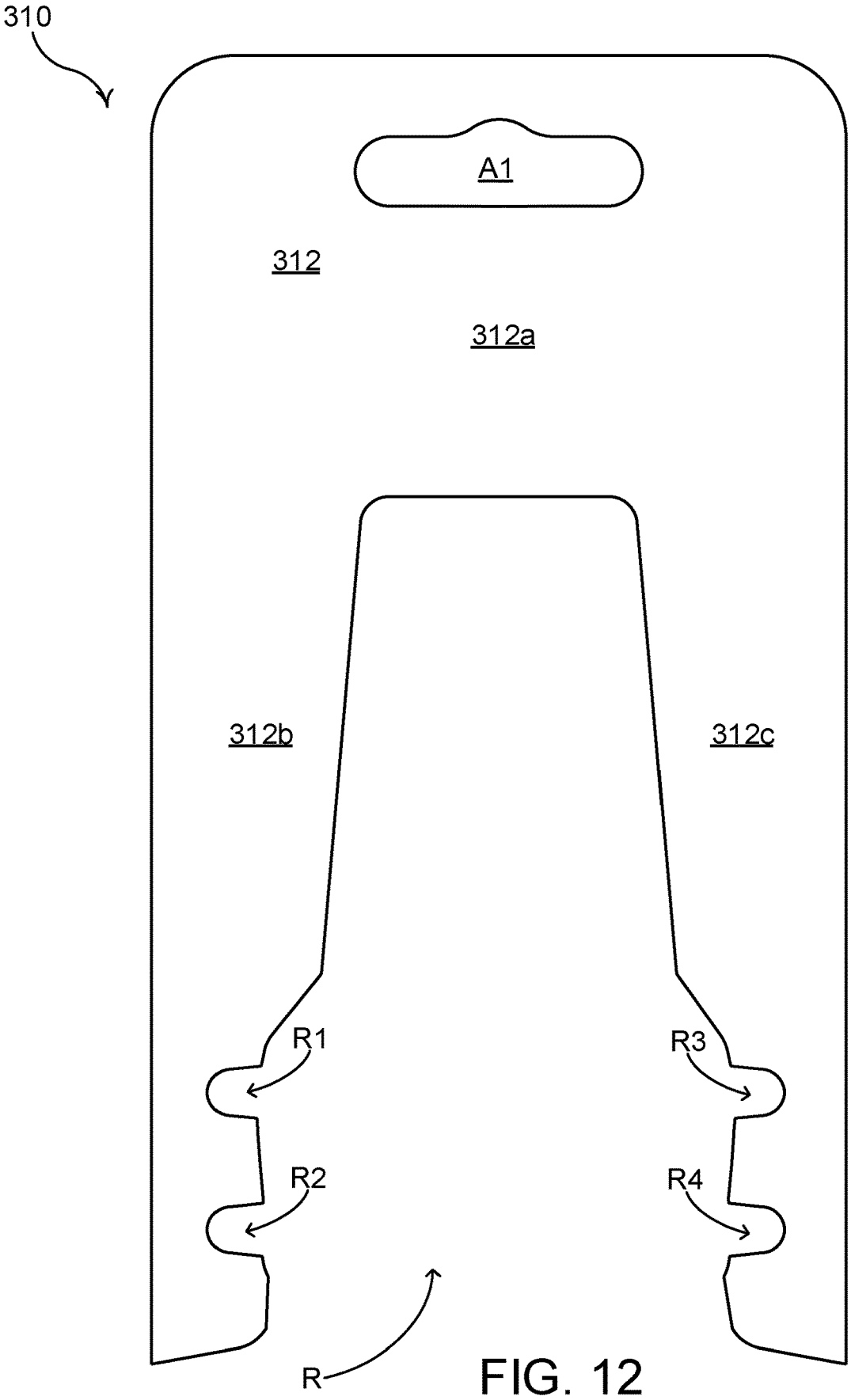
FIG. 12 is a plan view from above of a first blank for forming a product package according to a third embodiment.
Figure 16:
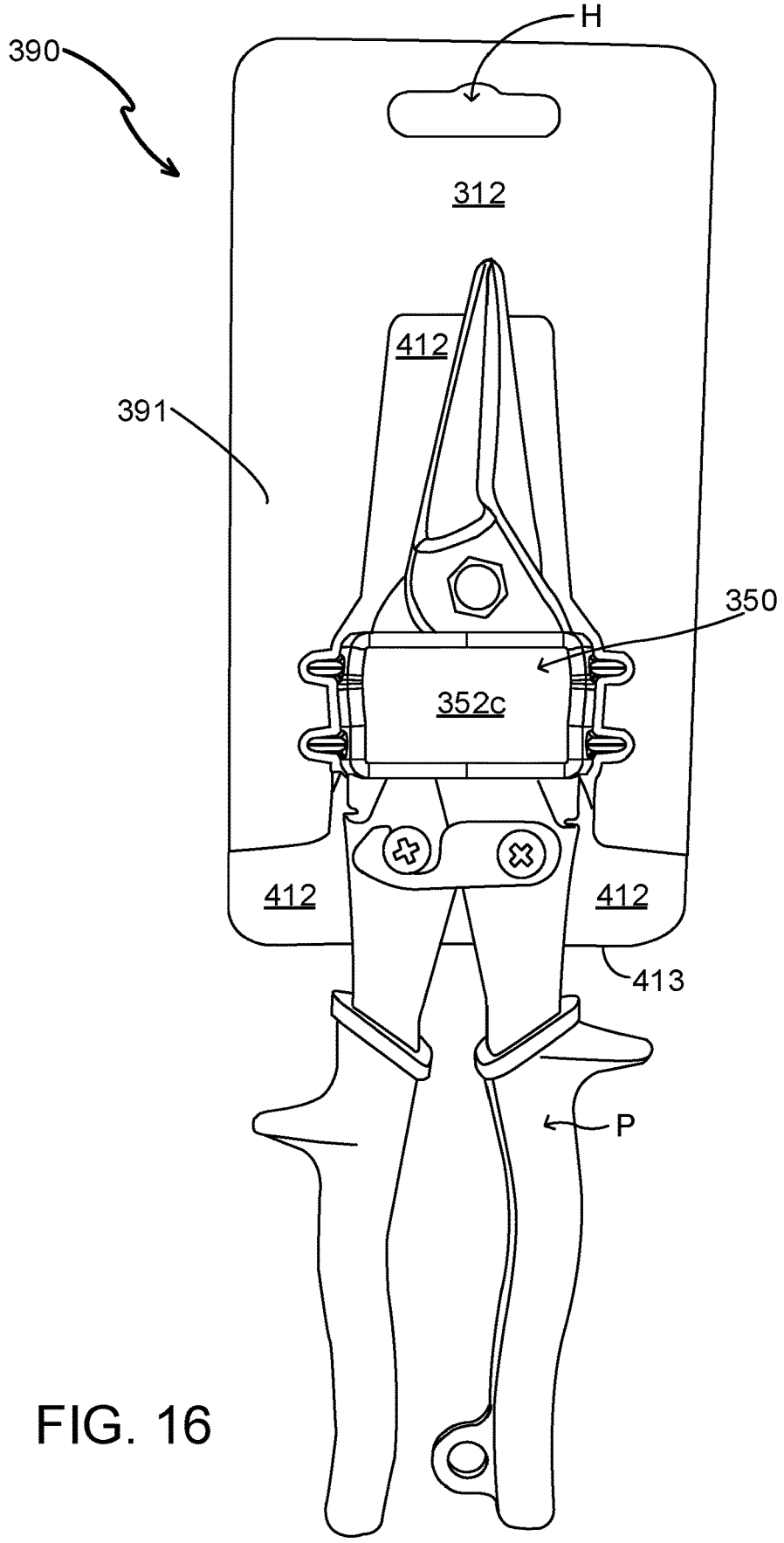
FIG. 16 is a perspective front view of a product packaged in a product carrier formed from the blank of FIGS. 12 and 13 and the clip of FIGS. 14A to 14D.

Referring to FIGS. 12 and 13, there is shown plan views of a first blank 310 and a second blank 410, according to yet another embodiment of the disclosure, capable of forming a packaging structure 90 in the form of a display card, as shown in FIG. 16. FIG. 14A to 14D show a further alternative clip or trap for mounting to an article P to the display card. The display card and clip form a product or article carrier.

The blanks 10, 110, 210, 310, 410 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures 90, 290, 390 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

Turning to FIG. 1, there is illustrated a first blank 10 for forming a part of a display card 91 (see FIG. 4) according to a first embodiment. The first blank 10 comprises a pair of main panels 12, 14 for forming a first front panel portion 12 and a rear panel 14 of the display card structure 91.

The pair of main panels 12, 14 comprises a first panel 12 and a second panel 14 hingedly connected together by a hinged connection in the form of a fold line 13.

The first panel 12 forms a part of a front panel of the display card 91. The first panel 12 comprises base portion 12A hinged to the second panel 14. The first panel 12 comprises tongue portion 12B extending from the base portion 12A. The tongue portion 12B is narrower in width than the base portion 12A such that opposed side edges E1, E2 of the tongue portion 12B are inset with respect to the respective side edges of the base portion 12A. The tongue portion 12B is substantially tapered in shape so as to reduce in width as it retreats from the hinged connection between the first and second panels 12, 14.

Each of the opposed side edges E1, E2 of the tongue portion 12B comprises at least one projection or boss L1, L2, L3, L4. In the illustrated embodiment each side edge E1, E2 comprises two bosses L1, L2, L3, L4.

Optionally, the first panel 12 comprises at least one first aperture A6, A7, A8, A9. In the illustrated embodiment the first panel 12 comprises four first apertures A6, A7, A8, A9.

Optionally, the second panel 14 comprises at least one second aperture A2, A3, A4, A5. In the illustrated embodiment comprises four second apertures A2, A3, A4, A5. Each of the at least one second apertures A2, A3, A4, A5 is arranged to be disposed in registry with a respective one of the at least one first apertures A6, A7, A8, A9 so as to form openings O1, O2, O3, O4 in the display card 91 when the first panel 12 is disposed in face contacting relationship with the second panel 14.

Optionally, the second panel 14 comprises a third aperture A10. The third aperture A10 may provide a hanger device to enable the display card 91 to be suspended from a display apparatus.

Referring to FIG. 2, there is illustrated a second blank 110 for forming a part of a display card 91 (see FIG. 4) according to a first embodiment. The second blank 110 comprises a main panel 112 for forming a second front panel portion 112 of the display card structure 91.

The main panel 112 comprises a main body portion 112*a* and a pair of limbs or prongs 112*b*, 112*c* which extend from the main body portion 112*a*. The main panel 112 is shaped complementarily to the first panel 12. In this way a major cutaway or recess R is defined in part by each of the pair of limbs 112*b*, 112*c* and the main body portion 112*a*. The main panel 112 may take the form of an inverted 'U' shape.

The tongue portion 12B is arranged to fit within the major recess R. The tongue portion 12B may form a close fit with main panel 112 within the major recess R.

The major recess R comprises a pair of opposed side walls or edges E3, E4. Each of the opposed side walls comprises at least one minor cutaway or recess R1, R2, R3, R4. In the illustrated embodiment each side wall comprises two minor recesses R1, R2, R3, R4.

Each of the minor recesses R1, R2, R3, R4 forms a receiver and is arranged to accommodate a respective one of the bosses L1, L2, L3, L4 of the first panel 12. The minor recesses R1, R2, R3, R4 may be shaped complementarily to their respective bosses L1, L2, L3, L4.

Figure 3A:
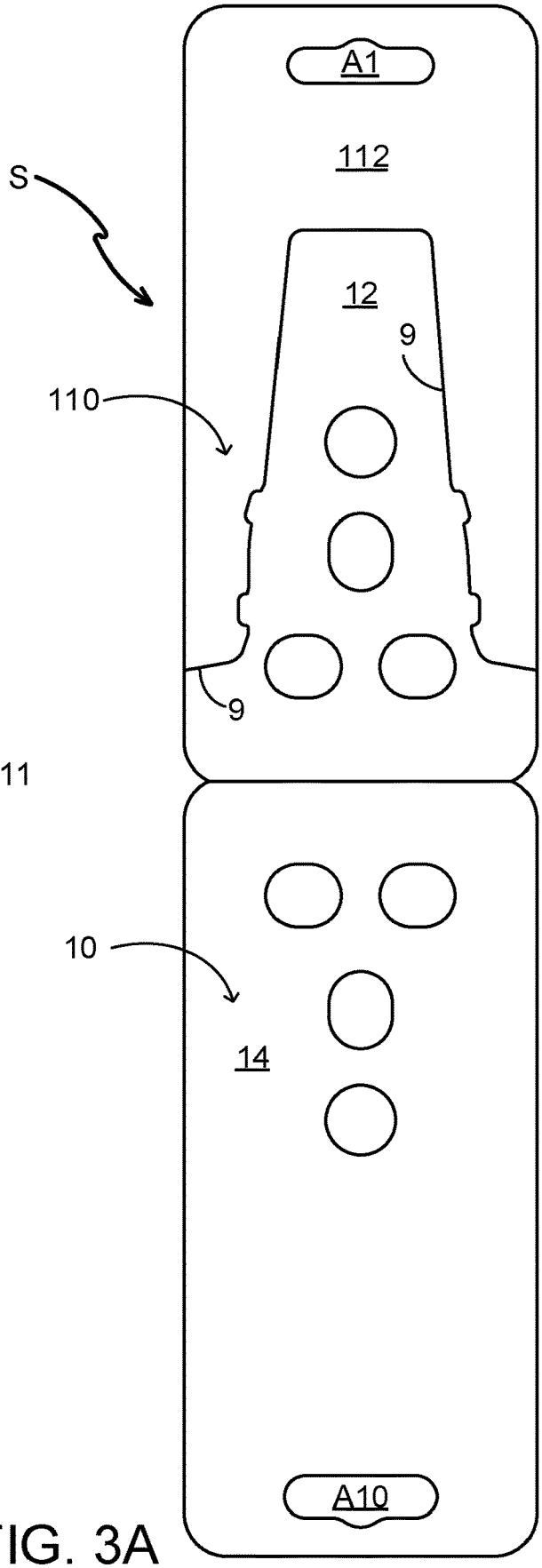
FIG. 3A is a plan view from above of the first and second blank of FIGS. 1 and 2.

The main panel 112 and the first and second panels 12, 14 may be formed from a single substrate S simultaneously see FIG. 3A. A single or common cutline or severable line 9 may be employed to separate the main panel 112 from the first panel 12.

Optionally, the main panel 112 comprises a fourth aperture A1. The fourth aperture A1 may define at least in part a hanger device to enable the display card 91 to be suspended from a display apparatus. The fourth aperture A1 may be arranged to be disposed in registry with the third aperture A10 when the main panel 112 is disposed in face contacting relationship with the second panel 14.

The main panel 112 and the first panel 12 are arranged to form a composite front panel 12/112 of the display card. The composite front panel 12/112 is arranged to be disposed in registry with the second panel 14 of the first blank 10. The composite front panel 12/112 provides a complete front display region.

Turning now to FIGS. 3B and 3C there is shown a clip 50 for use with the first and second blanks 10, 110. The clip 50 provides a pocket or cavity, the cavity is defined by a first side wall 52, a second side wall 54 and a front wall 56.

The first and second side walls comprise at least one embossment 58A, 58B, 58C, 58D. In the illustrated embodiment each side wall 52, 54 comprises two embossments 58A, 58B, 58C, 58D.

Each embossment 58A, 58B, 58C, 58D provides an external protrusion or lug extending from an outer surface of a respective one of the first and second side walls 52, 54. Each embossment 58A, 58B, 58C, 58D provides an internal trough or recess in an inner surface of a respective one of the first and second side walls 52, 54.

The recesses in the inner surfaces of the first and second side walls 52, 54 are arranged to accommodate the bosses L1, L2, L3, L4 of the first panel 12. In this way the bosses L1, L2, L3, L4 of the first panel 12 fit within the recesses in the inner surfaces the first and second side walls 52, 54.

The external protrusions extending from the outer surfaces of the first and second side walls 52, 54 are arranged to be accommodated within the minor recesses R1, R2, R3, R4 of the main panel 112.

The embossments 58A, 58B, 58C, 58D, minor recesses R1, R2, R3, R4 and bosses L1, L2, L3, L4 cooperate to align or locate the clip 50 with respect to the display card 91. They may also serve to interlock the clip 50 with the display card 91. This may increase the load bearing capacity of the package 90.

The front wall 56 may be contoured or shaped by a further embossment or moulding 59 so as to from a close fit with the article P. The first and second side walls 52, 54 may be similarly contoured or shape to accommodate the article P.

The clip 50 comprises a pair of flanges T1, T2. A first flange T1 extends from a lower end of the first side wall 52. A second flange T2 extends from a lower end of the second side wall 54.

Turning to the construction of the package 90 as illustrated in FIG. 4, the display card 91 can be formed by a series of sequential folding operations. The folding process is not limited to that described below and may be altered according to particular manufacturing requirements.

The first blank 10 is folded about fold line 13 such that the first panel 12 is brought into face contacting relationship with the second panel 14, as indicated by direction arrow D1 in FIG. 3D.

The first panel 12 may be secured to the second panel 14.

In some embodiments this may be done by heat sealing or radio frequency (RF) sealing or welding. The substrate of the blank 10 may comprise a coating or layer on at least one side to provide a bonding surface which responds to such treatment. A bonding surface of the first panel 12 is brought into face to face contacting relationship with a bonding surface of the second panel 14. In some embodiments, the bonding coating or layer may also serve to provide a tear resistant layer. In other embodiments, glue or other adhesive treatment may be applied to the inner surface of the first or second panels 12, 14 prior to bringing them into face contacting relationship.

Figure 6A:
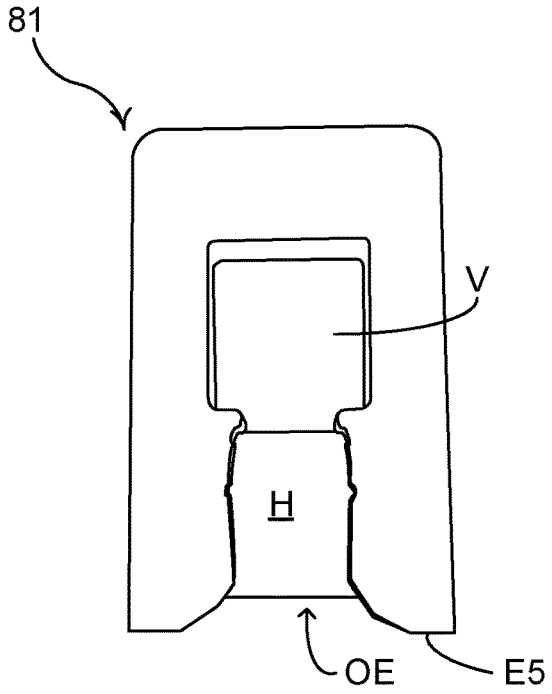
FIGS. 6A to 6D illustrate stages of construction of the product package of FIG. 4.
Figure 6B:
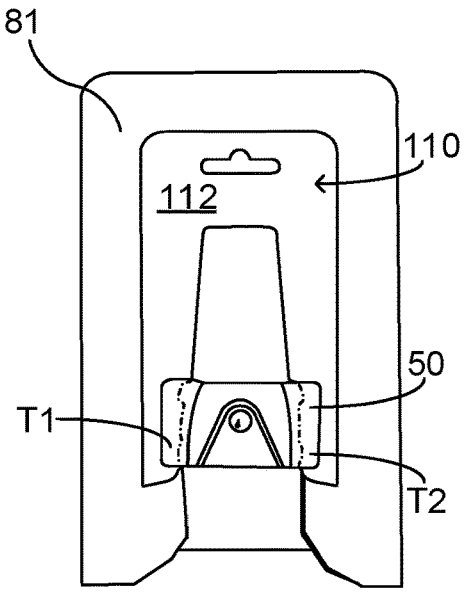
Figure 6C:
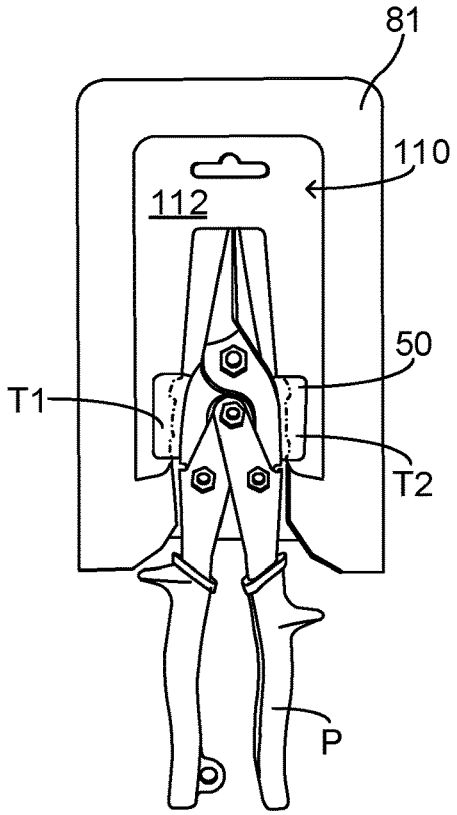

The main panel 112 is placed on a jig 81 as shown in FIG. 6B. The jig 81 comprises a void V (best shown in FIG. 6A) arranged to accommodate the article P or at least a portion thereof. The void V may be closed at a first end. The void V may be open OE at a second end E5 such that the void interrupts an end edge of the jig 81. The void V may be at least partially blind so as to define a shelf H.

The major recess R is vertically aligned with the void V, such that the limbs 112*b*, 112*c* extend about the void V. The main panel 112 may obscure, cover or extend over a portion of the void V.

The clip 50 is placed upon the main panel 112, the first and side walls 52, 54 extend into the void V such that the cavity of the clip 50 is disposed within the void V of the jig 81. The first flange T1 is placed upon one of the pair of limbs 112*b*, 112*c*. The second flange T2 is placed upon the other one of the pair of limbs 112*b*, 112*c*. The embossments 58A, 58B, 58C, 58D are aligned with the minor recesses R1, R2, R3, R4.

The article P is then mounted upon the jig 81. At least a portion of the article P is received in the void V, a portion of the article P is arranged so as to be disposed at an elevation below the main panel 112. A portion of the article P may be arranged so as to underlie the main panel 112. The article P is received in the cavity of the clip 50.

Figure 6D:
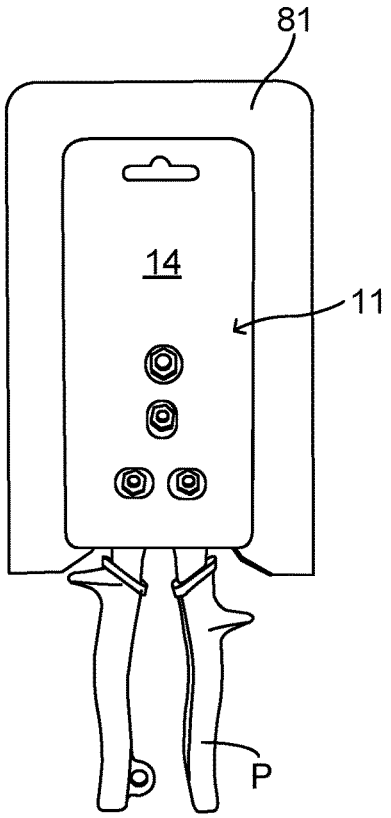

The first blank 10 in the folded condition illustrated in FIG. 3D is then placed overt the article P, main panel 112 and jig 81, as shown in FIG. 6D. Portions of the article P may extend or pass through openings O1, O2, O3, O4 (see FIG. 5), provided by the first and second apertures A6, A7, A8, A9; A2, A3, A4, A5, in the display card 91.

The second panel 14 is secured to the first panel 12 and to the main panel 112. In some embodiments this may be done by heat sealing or radio frequency (RF) sealing or welding. A platen or similar tool may be placed over or upon the second panel 14 to as to bond the second panel 14, first panel 12 and the main panel 112 together. The clip 50 is disposed or sandwiched between the main panel 112 and the second panel 14. The clip 50 is secured between the main panel 112 and the second panel 14.

The clip 50 secures the article P to the display card 91.

It will be appreciated that in other embodiments the method may be reversed. The article P may be placed upon the first blank 10, in the folded condition illustrated in FIG. 3D. The clip 50 may be placed over the product so that the flanges T1, T2 are disposed in face contacting relationship with the second panel 14. The main panel 112 may be placed in face contacting relationship with the second panel 14 and secured thereto. In embodiments in which the main panel 112 underlies at least a portion of the article P the main panel 112 may require manipulation past the article P.

Referring to FIG. 4 the major recess R in the main panel 112 is dimensioned such that a portion of the main body 112*a* underlies an end portion of the article P. The major recess R is wider in dimension than the portion of the article P which it surrounds, but is shorter in length than said portion of the article P.

In still yet other embodiments the major recess R may be dimensioned to be longer in length than the portion of the article P which it surrounds. The tongue portion 12B may be similarly increased in length.

Together the main panel 112 and the first panel 12 form a composite front panel 12/112 of the display card 91. The main panel 112 and the first panel 12 are complementary such that a complete display area is formed around and behind the article P.

Referring now to FIGS. 7A to 16 there is shown alternative embodiments of the present disclosure. In the second and third illustrated embodiments, like numerals have, where possible, been used to denote like parts, albeit with the addition of the prefix "200" and "300" or "400" to indicate that these features belong to the second or third embodiment. The second and third embodiments share many common features with the embodiment of FIGS. 1 to 6D, therefore only the differences from the embodiment illustrated in FIGS. 1 to 6D will be described in any greater detail.

Figure 13A:
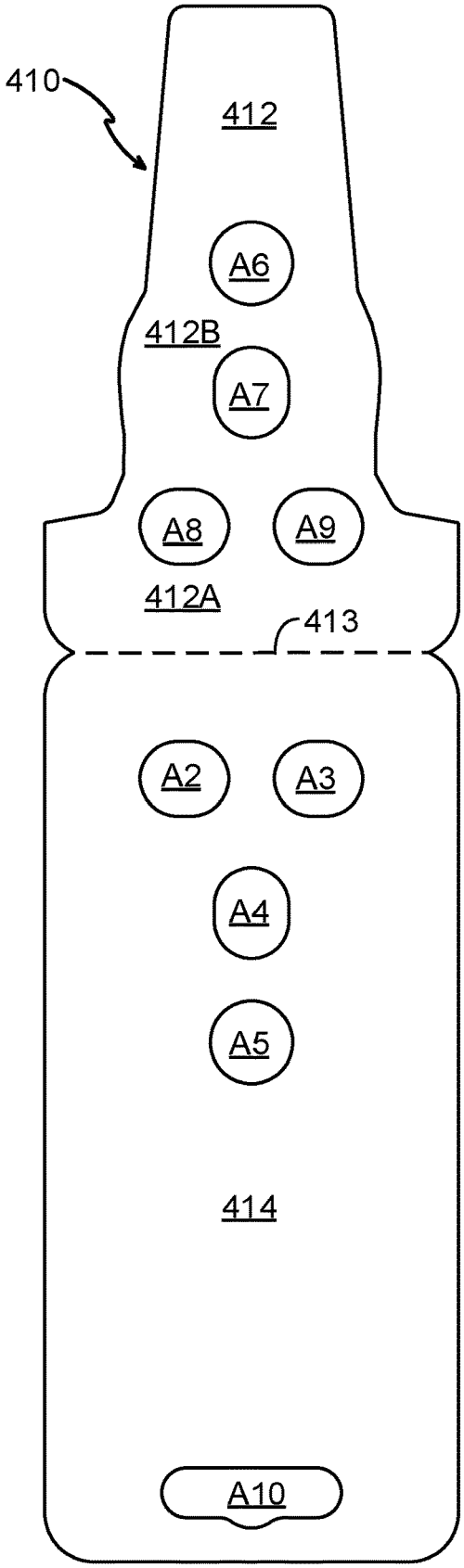
FIG. 13A is a plan view from above of a second blank for forming a product package according to a third embodiment.
Figure 15:
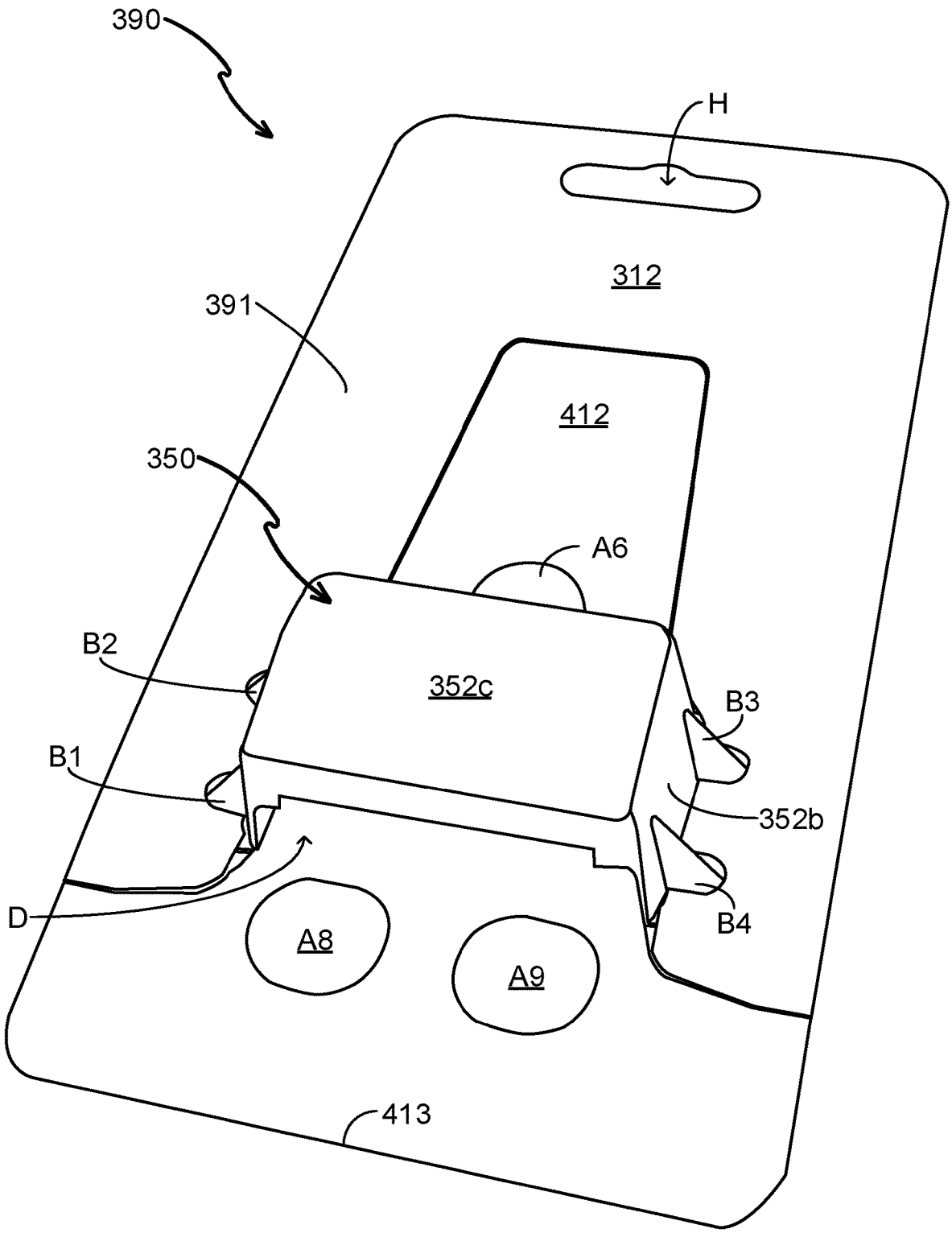
FIG. 15 is a perspective view of a product carrier formed from the blank of FIGS. 12 and 13 and from the clip of FIGS. 14A to 14D.

Referring to FIG. 12 there is shown a second blank 312 for forming a display card 391 according to a third illustrated embodiment. FIG. 13A illustrates a first blank 412 for forming a display card 391 according to the third illustrated embodiment. FIGS. 14A to 14D illustrate a clip 350 for forming a package or carrier 390 with the blanks of FIGS. 12 and 13A, as illustrated in FIGS. 15 and 16.

The clip 350 may be formed from a thermosetting plastic for example, but not limited to, by injection moulding. The clip 350 comprises a front wall 352*c*. A first side wall 352*a* extends from a first end of the front wall 352*c*. A second side wall 352*b* extends from a second end of the front wall 352*c*.

A first flange or tab T1 extends outwardly from the first side wall 352*a*. A second flange or tab T2 extends outwardly from the second side wall 352*b*.

The clip 350 comprises at least one boss or brace B1, B2 extending between the first flange T1 and the first side wall 352*a*. The illustrated embodiment comprises two braces B1, B2.

The clip 350 comprises at least one boss or brace B3, B4 extending between the second flange T2 and the second side wall 352*b*. The illustrated embodiment comprises two braces B3, B4.

The braces B1, B2, B3, B4 may provide structural reinforcement to the clip 350 improving strength and/or rigidity of the clip 350.

The braces B1, B2, B3, B4 may improve rigidity of the flanges T1, T2.

The braces B1, B2, B3, B4 may further serve as alignment guides for aligning the clip 350 with respect to the display card 391. The second blank 310 comprises a main panel 312 having a main body 312*a*; a first limb 312*c* and a second limb 312*c* extend from the main body 312*a* so as to define a cutaway or major recess R therebetween. Each limb 312*b*, 312*b* comprises at least one minor recess R1, R2, R3, R4. The minor recesses R1, R2, R3, R4 are arranged to receive at least a portion of one of the braces B1, B2, B3, B4. In this way the main panel 312 is aligned with clip 350 and may be interlocked therewith.

Figure 13B:
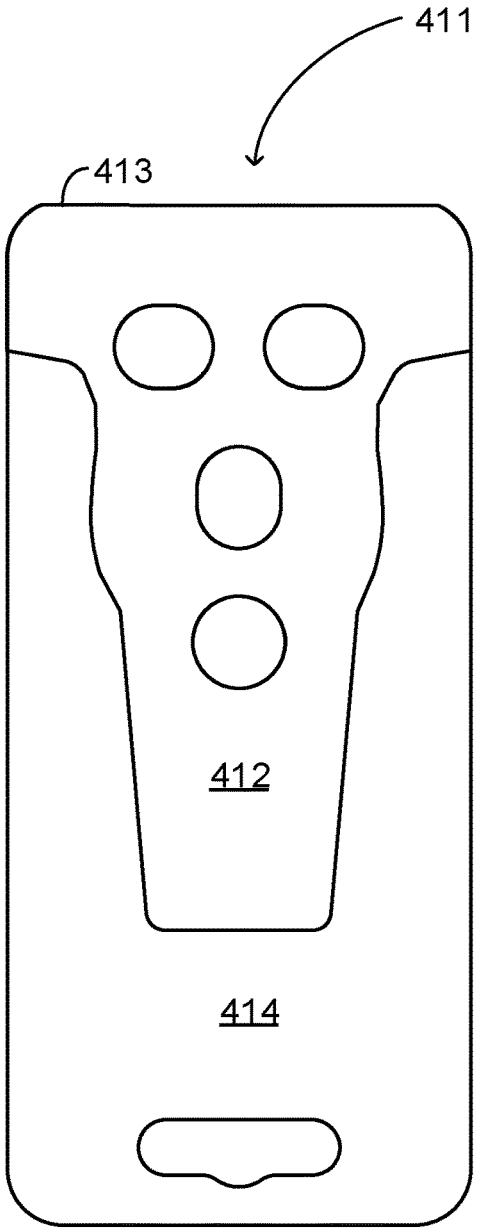
FIG. 13B illustrates a stage of construction of a display card from the blank of FIG. 13A.
Figure 14C:
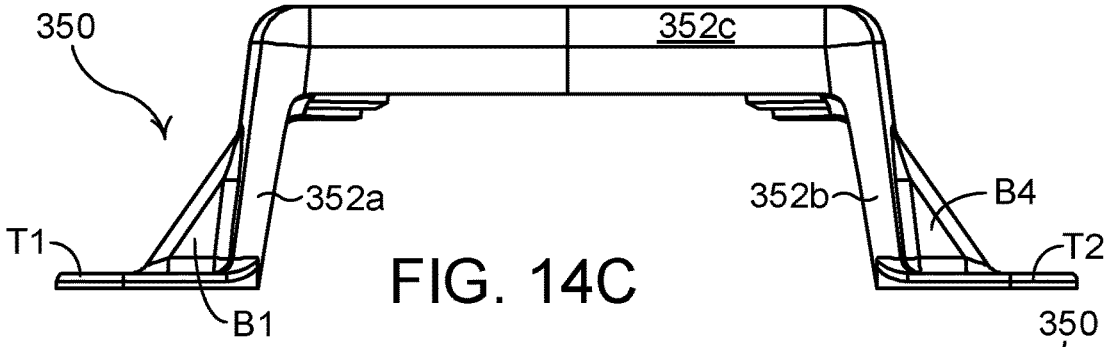
FIGS. 14A to 14D illustrate perspective, top, side and end views of a clip for forming a product package with the blanks of FIGS. 12 and 13.
Figure 14B:
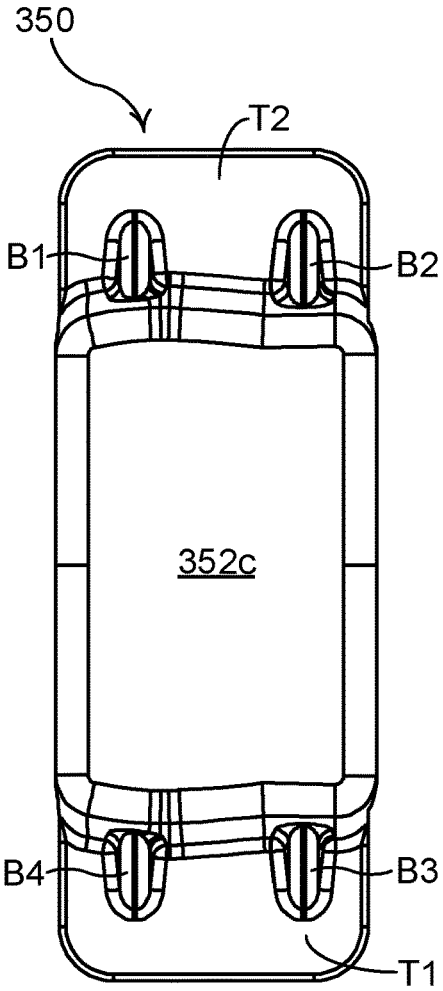
Figure 14D:
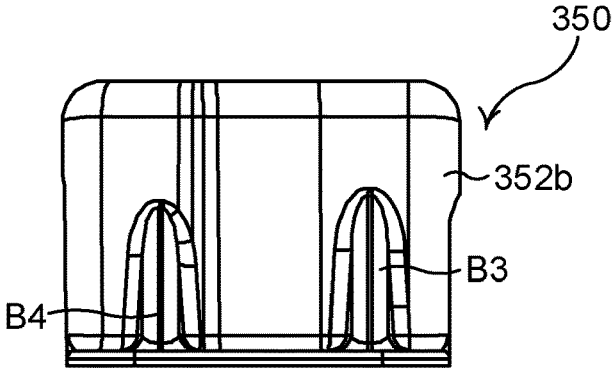
Figure 14A:
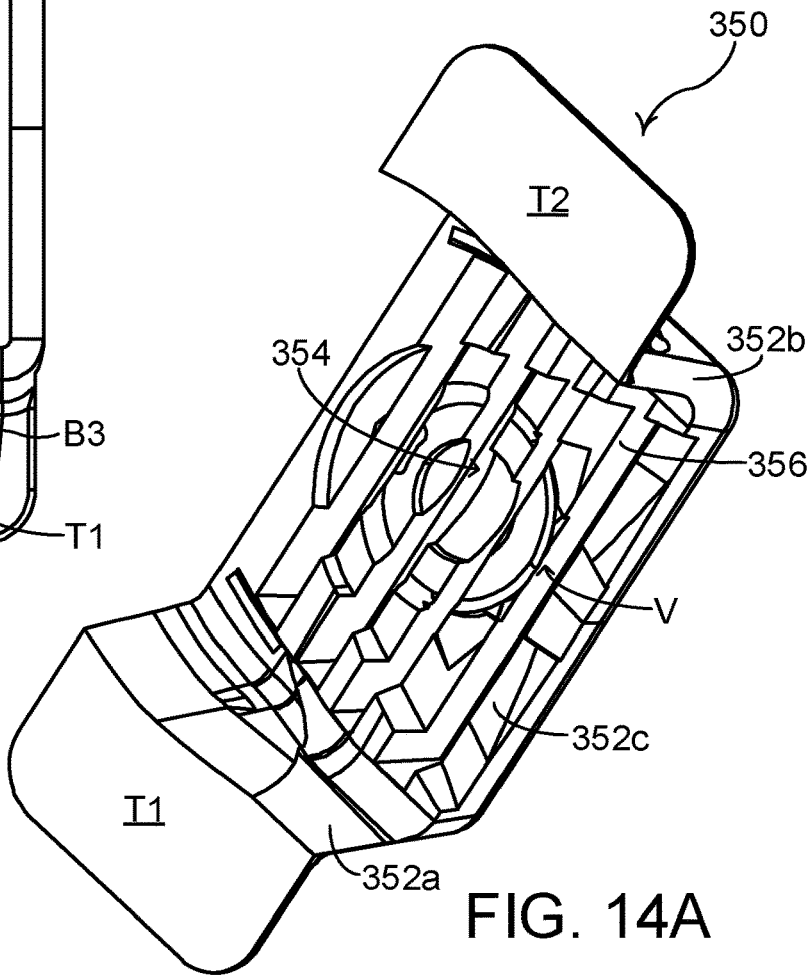

FIG. 13B shows the first blank 410 in a folded condition for securing to the second blank 310. The clip 350 together with the display card 391 defines a tubular structure D open at both ends for receiving the product P. Portion of the product P extend outwardly from each open end of the tubular structure D.

The outer surface of the front wall 352*a* of the clip 350 may provide a branding or display region for display of indicia, the indicia may be printed, affixed, moulded or otherwise defined thereon.

The inner surface of the front wall 352*a* of the clip 350 may comprise one or more ribs or ridges 356 for increasing strength of the clip 350.

The inner surface of the front wall 352*a* of the clip 350 maybe indented or notched to define a recess V to provide a mortise 354 for receiving a portion of the product P so as to interlock the clip 350 and the product P.

A portion of the tongue 412B of the first panel 412 may be shaped to be received within the first and second side walls 352*b*, 352*c* of the clip 350. The bosses L1, L2, L3, L4 of the first panel 12 of the embodiment of FIG. 1 have been omitted from the embodiment of FIG. 13A.

The main panel 312 and the first panel 412 together form a front panel 312/412 of the display card 391. The main panel 312 and the first panel 412 together define a pair of apertures in the front panel 312/412 each of which receives one of the first and second side walls 352*b*, 352*c* and their associated braces B1, B2, B3, B4.

Optionally, the second panel 414 comprises a third aperture A10. The third aperture A10 may provide a hanger device H to enable the display card 391 to be suspended from a display apparatus (not shown).

Optionally, the main panel 312 comprises a fourth aperture A1. The fourth aperture A1 may provide define at least in part a hanger device H to enable the display card 391 to be suspended from a display apparatus. The fourth aperture A1 may be arranged to be disposed in registry with the third aperture A10 when the main panel 312 is disposed in face contacting relationship with the second panel 414.

Figure 9:
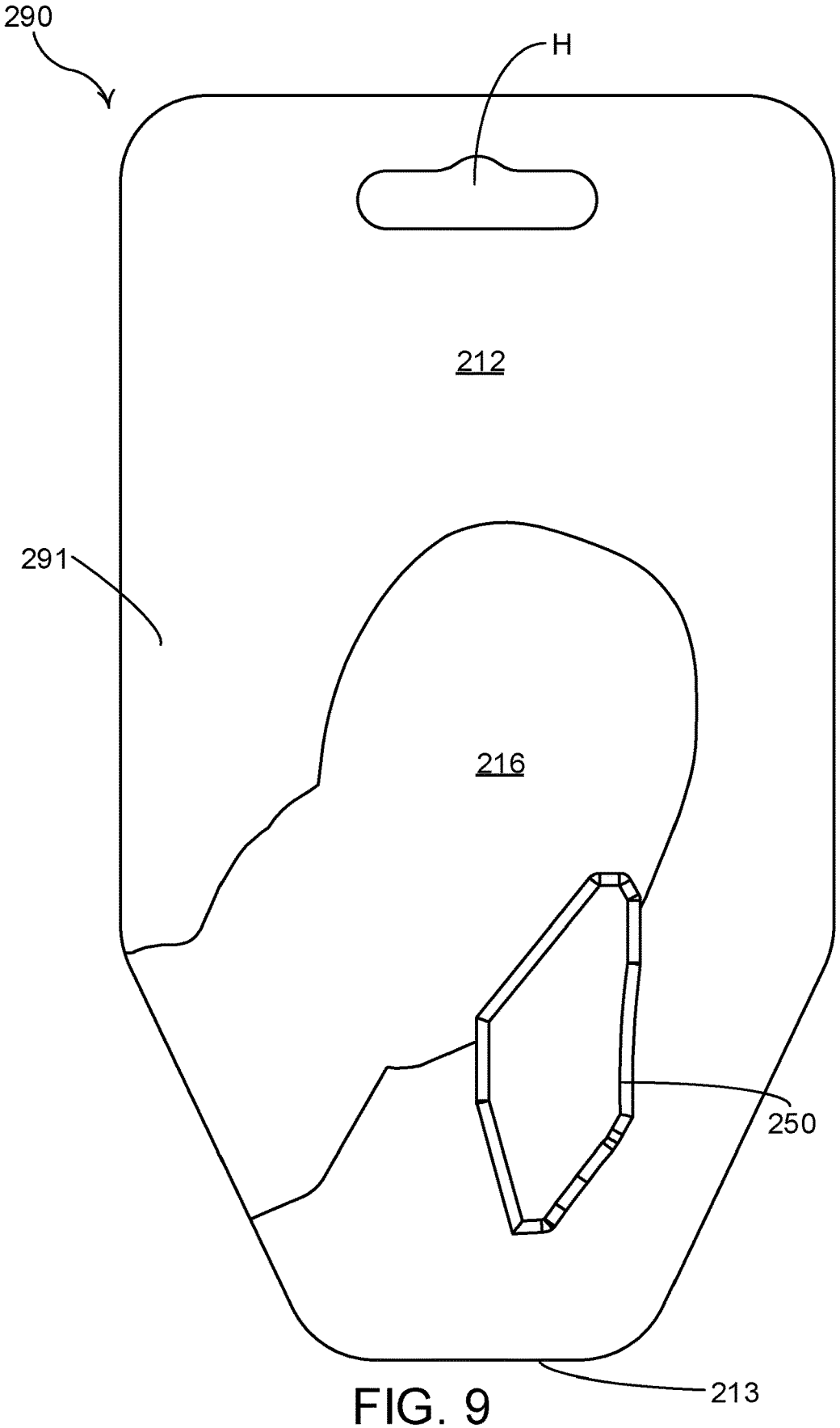
FIGS. 9 and 10 are a perspective front view of a package formed from the blank of FIG. 7 and the clip of FIGS. 8A to 8D.
Figure 10:
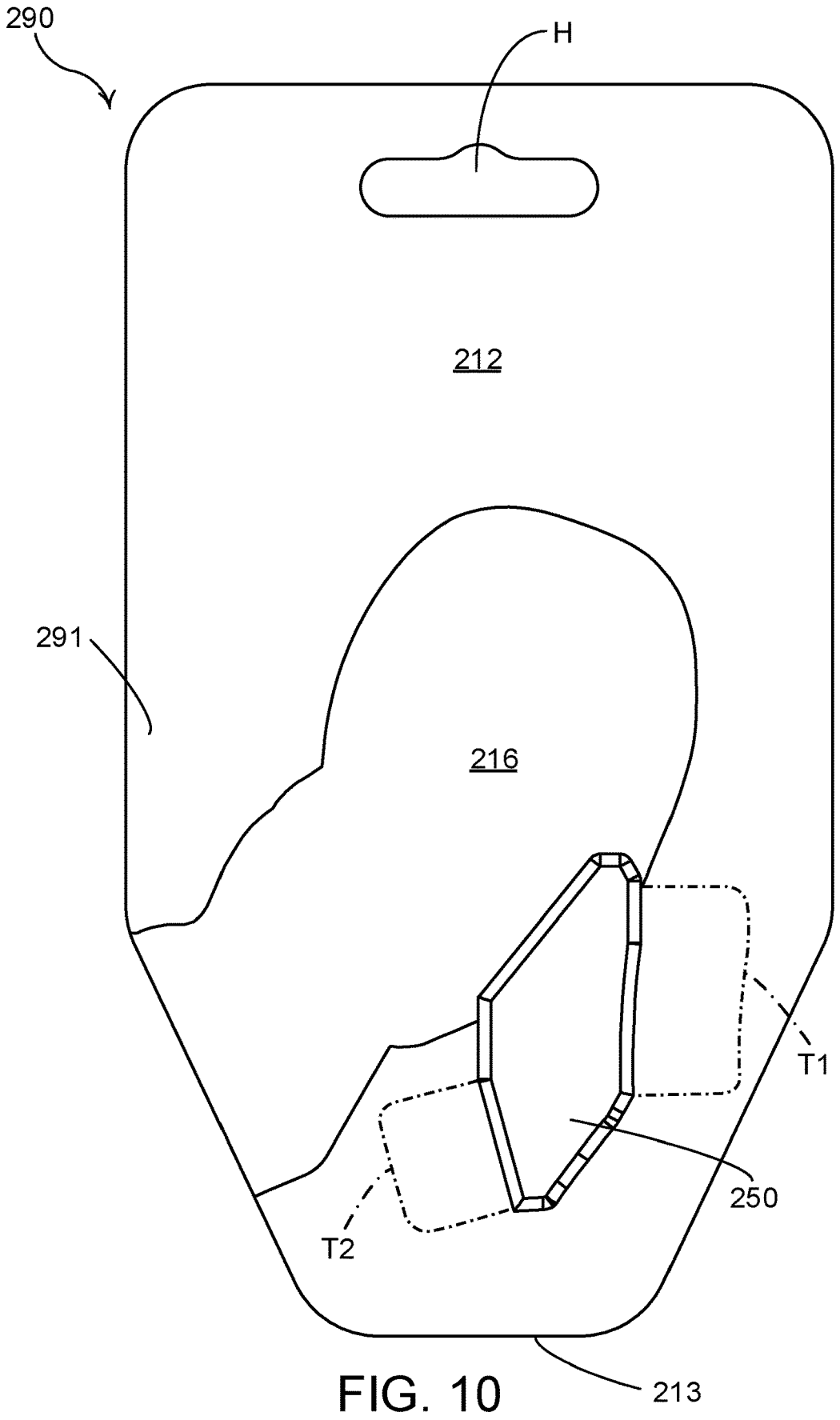

Referring to FIG. 7A there is shown a blank 212 for forming a display card 291 according to a second illustrated embodiment. FIGS. 8A to 8D illustrate a clip 250 for forming a package 290 with the blank of FIG. 7A, as illustrated in FIGS. 9 to 11.

Blank 210 comprises a front panel 212 hinged to a rear panel 214 by a hinged connection in the form of a fold line 213.

The front panel 212 comprises a detachable front panel portion 216. The detachable front panel portion 216 is defined by a cutline or severable line 215. The cutline 215 defines a cutaway C (see FIG. 7B) extending from a side edge of the front panel 212. The cutaway C may extend substantially diagonally or obliquely from the side edge of the front panel 212.

An aperture A13 is struck from the front panel 212. The aperture A13 intersects with the cutline 215. In this way the aperture A13 is contiguous with the cutaway C defined by the cutline 215 when the detachable front panel portion 216 is separated from the remainder of the front panel 212.

The aperture A13 and the detachable front panel portion 216 share a common portion of the cutline 215. The aperture A13 may be considered to be a recess struck from the portion of the front panel 212 which remains hingedly connected to the rear panel 214.

Optionally, the front panel 212 comprises a first hanger aperture A11. The first hanger aperture A11 may provide a hanger device H to enable the display card 291 to be suspended from a display apparatus.

Optionally, the rear panel 214 comprises a second hanger aperture A12. The second hanger aperture A12 may provide define at least in part a hanger device H to enable the display card 291 to be suspended from a display apparatus. The second hanger aperture A12 may be arranged to be disposed in registry with the first hanger aperture A11 when the front panel 212 is disposed in face contacting relationship with the rear panel 214.

Figure 7B:
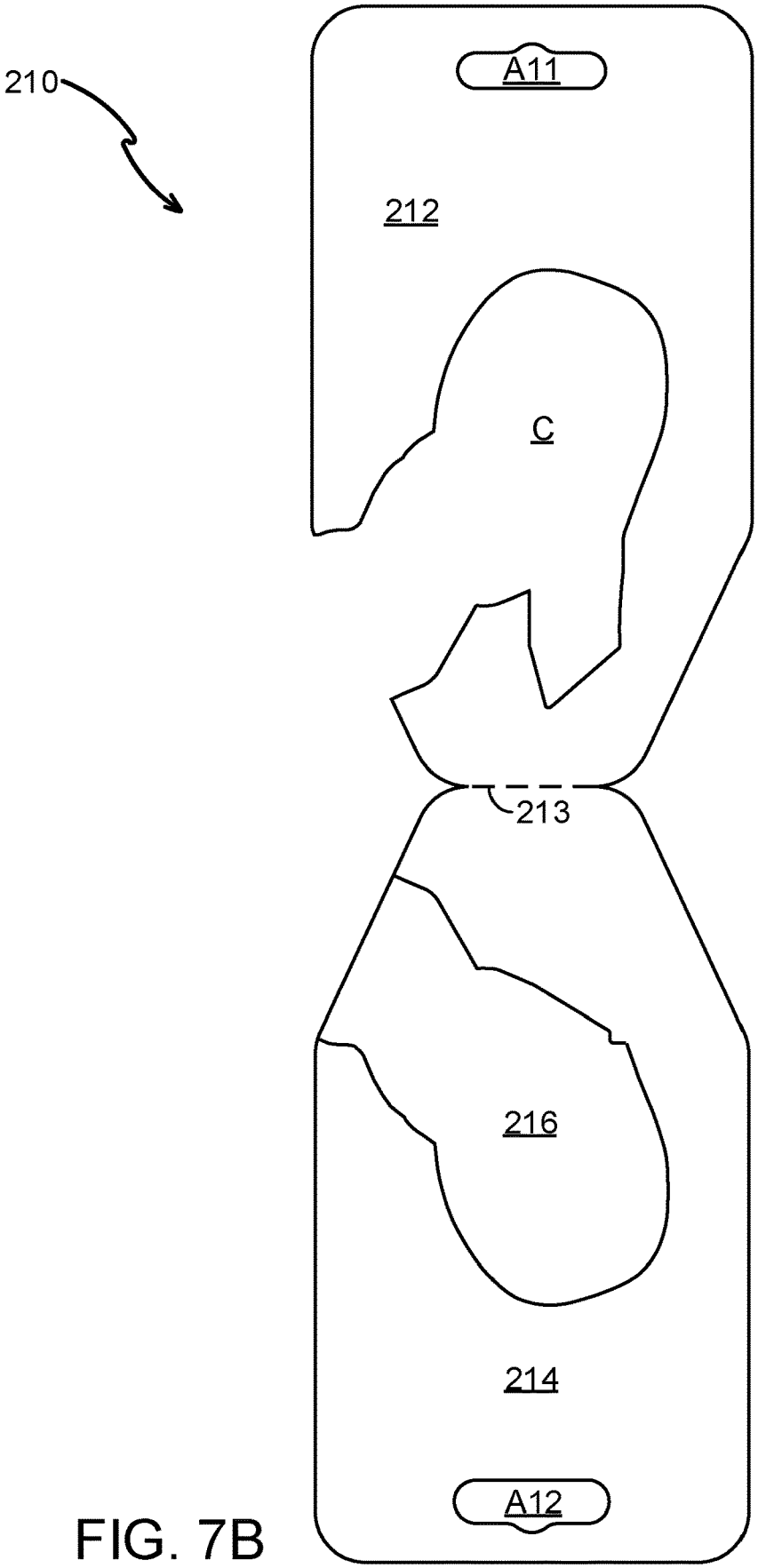
FIG. 7B illustrates a stage of construction of a product package from the blank of FIG. 7.
Figure 8A:
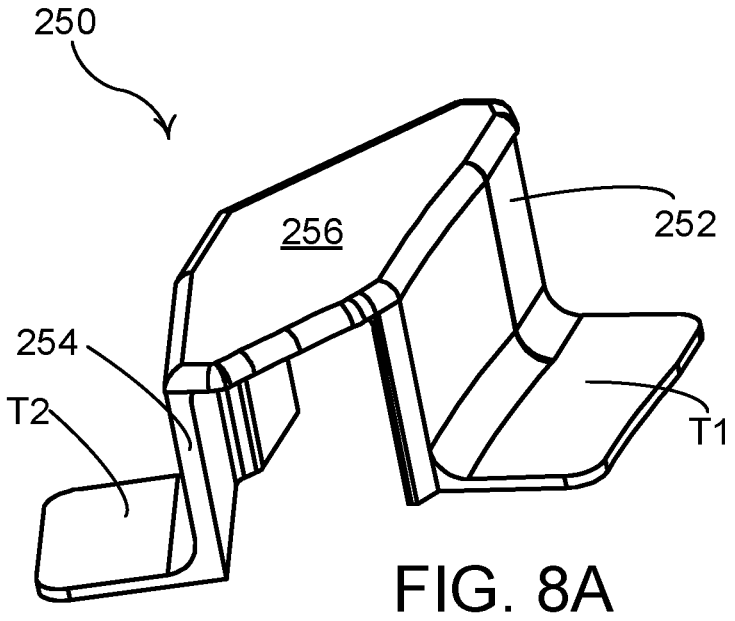
FIGS. 8A to 8D illustrate perspective, top, side and end views of a clip for forming a product package with the blank of FIG. 7.
Figure 8C:
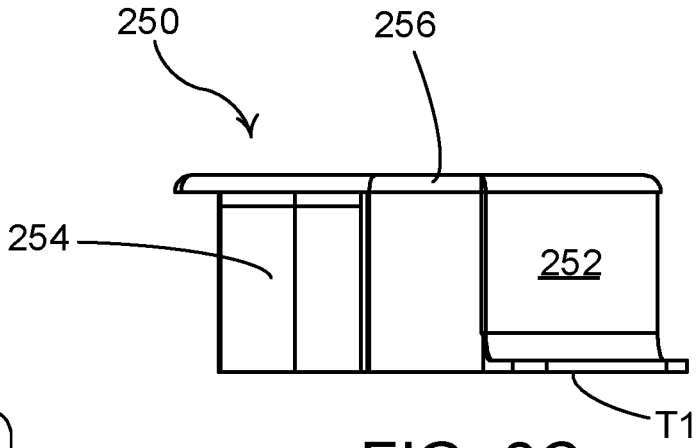
Figure 8B:
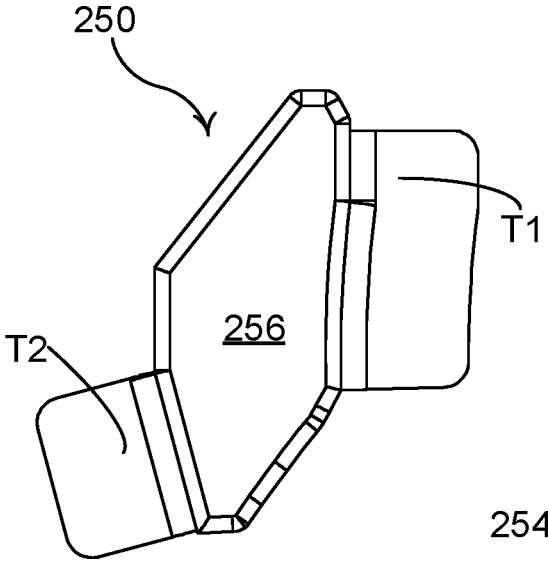
Figure 8D:
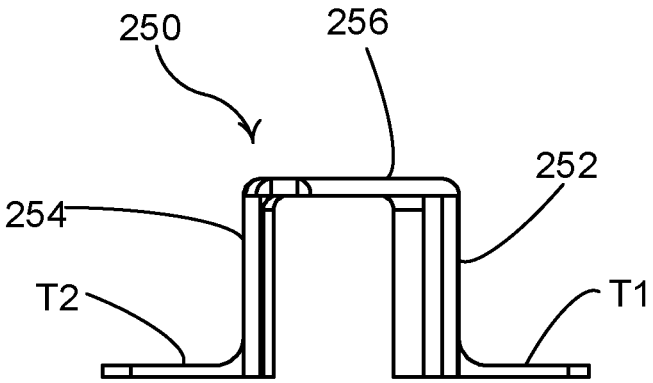

The detachable front panel portion 216 is secured to the rear panel 214 as shown in FIG. 7B. This may be achieved by folding the front panel 212 into face contacting relationship with the rear panel 214. In some embodiments this may be done by heat sealing or radio frequency (RF) sealing or welding. The substrate of the blank 210 may comprise a coating or layer on at least one side to provide a bonding surface which responds to such treatment. A bonding surface of the front panel 212 is brought into face to face contacting relationship with a bonding surface of the rear panel 214. In some embodiments, the bonding coating or layer may also serve to provide a tear resistant layer. In other embodiments, glue or other adhesive treatment may be applied to the inner surface of the detachable front panel portion 216 or corresponding region of the rear panel 214 prior to bringing the front and rear panels 212, 214 into face contacting relationship.

The front panel 212 may be unfolded with respect to the rear panel about fold line 213. In this way the detachable front panel portion 216 is separated from the front panel 212, as shown in FIG. 7B.

The clip 250 is then mounted to the front panel 212, the flanges T1, T2 of the clip 250 are disposed in face contacting relationship with an inner surface of the front panel 212 on opposing sides of the aperture A13 (best shown in FIG. 10). The article P is inserted through the cutaway in the front panel 212 and a portion of the article P is inserted into a cavity defined by the clip 250. The clip 250 and the display card 291 together define an open ended tubular structure through which said portion of the article P passes or extends.

In some embodiments the article P and clip 250 may be mounted to the front panel 212 simultaneously.

The rear panel 214 is then folded with respect to the front panel 212 to be brought into face to face contacting relationship.

The rear panel 214 is folded with respect to the front panel 212 to be brought into registry therewith.

The detachable front panel portion 216 is brought into a substantially coplanar relationship with the front panel 212 so as to form a complete display region behind and/or around the article P as shown in FIG. 11.

The assembled package 90 is shown in FIG. 11, in the illustrated embodiments the article P being packaged is a pair of pliers, optionally, but not limited to, diagonal pliers, snips, side cutters or wire cutters.

The flanges T1, T2 are secured between the front panel 212 and the rear panel 214 below the detachable front panel portion 216 as shown in FIG. 10.

The article P comprises at least one limb. The article P is mounted to the display card 90 by at least one of the limb of the article P.

The article P comprises a pair of levers pivotally attached to each other. Optionally, the product comprises a pair of first-class levers joined at a fulcrum. The fulcrum is positioned closer to one end of the levers, creating short jaws on one side of the fulcrum and longer handles on the other side of the fulcrum.

The article P is mounted to the display card 291 by one of the levers referred herein as the mounted lever. The clip 250 partially surrounds one of the handles of the article P. In this way the other of the levers, also referred to as the unmounted lever, can be pivoted with respect to the mounted lever. This allows inspection and/or testing of the product without removal from the display card 291.

The clip 250 may be arranged to allow partial opening of the jaws. In other embodiments, the clip 250 may be arranged so as to prevent or inhibit movement of the pair of levers with respect to each other.

A portion of the clip 250 such as an end or side edge of one of the walls 252, 254, 256 may provide an end stop or detent to resist or deter motion of the unmounted lever with respect to the mounted lever.

The article P may comprise features which provide end stops for preventing, inhibiting or limiting translational movement of the mounted lever within a tubular structure defined in part be the clip 250 and in part by the display card 291. For example, the mounted limb of the article P may comprise a grip or handle cover mounted to the limb which provides a shelf or shoulder which is dimensioned or otherwise arranged such that it cannot pass into the tubular structure.

The present disclosure provides a package 90; 290; 390 comprising a display card 91; 291; 391 a product P is mounted to the display card 91; 291; 391 by a clip 50; 250; 350. The display card 91; 291; 391 comprises a front panel 12/112; 212; 312/412, a rear panel 14; 214; 414. The clip 50; 250; 350 comprises a front wall 56; 256; 352*c* and opposed side walls 52, 54; 252, 254; 352*a*, 352*b*. The clip 50; 250; 350 together with at least one of the front and rear panels 12/112, 14; 212, 214; 312/414, 414 form a tubular structure for receiving a part of the product P. The product P may comprise a pair of limbs or arms, each arm may comprise a handle grip. The product P may be mounted to display card 91; 291; 391 by at least one of the arms. The clip 50; 250; 350 may be mounted on said at least one arm between a pair of end stops for inhibiting removal of the product P from the display card 91; 291; 391.

The display card 91; 291; 391 may be formed from a first front panel portion 12; 212; 412 hingedly connected to a rear panel 14; 214; 414. The display card 91; 291; 391 may comprise a second front panel portion 112; 216; 312 arranged complementarily to the first front panel portion 12; 212; 412 so as to form a substantially complete front display region for display of indicia.

The clip 50; 250; 350 may comprise at least one flange disposed between the front and rear panels 12/112, 14; 212, 214; 312/414, 414.

The front panel 12/112; 212; 312/412 comprises one or more cutaways or apertures providing abutment edges for interacting with a portion of the clip 50; 250; 350 which extends through said one or more cutaways or apertures.

The clip 50; 350 may comprise at least one boss 58A, 58B, 58C, 58D; B1, B2, B3, B4. The display card 91; 391 may comprise at least one receiver R1, R2, R3, R4; A13. The receiver R1, R2, R3, R4; A13 may take the form of a cutaway or recess struck from the front panel 12,112; 212; 312,412.

The receiver R1, R2, R3, R4; may take the form of a cutaway or recess struck from one of the first and second front panel portions 12,112; 312,412.

The display card 91; 291; 391 may be formed from a paperboard substrate optionally having a tear resistant layer. The clip 50; 250; 350 may be formed from a plastics material.

It can be appreciated that various changes may be made within the scope of the present invention. For example, the size and shape of the panels may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A package comprising a display card and a clip, and an article is mounted to the display card by the clip, wherein the display card comprises a front panel and a rear panel, the clip comprises a front wall and opposed side walls, and wherein the clip together with at least one of the front and rear panels forms a tubular structure for receiving a part of the article, the article comprises at least one limb, and the article is mounted to the display card by the at least one limb which extends through the tubular structure, wherein the front panel comprises a first front panel portion hingedly connected to the rear panel, wherein the front panel further comprises a second front panel portion arranged complementarily to the first front panel portion so as to form a substantially complete front display region for display of indicia, wherein the first front panel portion comprises a base portion hingedly connected to the rear panel and a tongue portion extending from the base portion, said tongue portion being narrower in width than the base portion such that opposed side edges of the tongue portion are inset with respect to respective side edges of the base portion, wherein the second front panel portion comprises a main body portion and a pair of prongs which extend from the main body portion so as to define a major recess, wherein said tongue portion of the first front panel portion is arranged to fit within the major recess.

2. A package according to claim 1 wherein the article comprises a pair of limbs and wherein the article is mounted to the display card by at least one of the limbs of the pair of limbs.

3. A package according to claim 1 wherein the clip is mounted on said at least one limb between a pair of end stops for inhibiting removal of the article from the display card.

4. A package according to claim 1 wherein each limb comprises a handle.

5. A package according to claim 1 wherein the clip comprises at least one flange disposed between the front and rear panels.

6. A package according to claim 1 wherein the front panel comprises one or more cutaways or apertures providing abutment edges for engaging with a portion of the clip which extends through said one or more cutaways or apertures.

7. A package according to claim 1 wherein the display card is formed from a paperboard substrate.

8. A package according to claim 7 wherein the paperboard substrate comprises a tear resistant layer.

9. A package according to claim 1 wherein the clip comprises at least one boss received in a receiver defined in the front panel.

10. A package according to claim 1 wherein the clip is formed from a plastics material.

11. A package according to claim 1, wherein the article is a pair of pliers.

12. A display card for receiving an article, the display card comprising a front panel and a rear panel and a clip, the clip comprising a front wall and opposed side walls and at least one flange, wherein the clip together with at least one of the front and rear panels forms a tubular structure for receiving a part of the article so as to enable the article to be mounted to the display card, and wherein the at least one flange is disposed between the front panel and the rear panel, each of the opposed side walls of the clip extending through a cutaway in the front panel, wherein the front panel comprises a first front panel portion hingedly connected to the rear panel, wherein the front panel further comprises a second front panel portion arranged complementarily to the first front panel portion so as to form a substantially complete front display region for display of indicia, wherein the first front panel portion comprises a base portion hingedly connected to the rear panel and a tongue portion extending from the base portion, said tongue portion being narrower in width than the base portion such that opposed side edges of the tongue portion are inset with respect to respective side edges of the base portion, wherein the second front panel portion comprises a main body portion and a pair of prongs which extend from the main body portion so as to define a major recess, wherein said tongue portion of the first front panel portion is arranged to fit within the major recess.

* * * * *